United States Patent [19]

Porter et al.

[11] 4,121,625

[45] Oct. 24, 1978

[54] DEVICE FOR EQUALIZING THE WARP YARN TENSION IN A LOOM

[75] Inventors: Allan William Porter, Lustmühle; Anton Lucian, Arbon, both of Switzerland

[73] Assignee: Adolph Saurer, Arbon, Switzerland

[21] Appl. No.: 820,370

[22] Filed: Jul. 29, 1977

[30] Foreign Application Priority Data

Aug. 13, 1976 [CH] Switzerland ..... 10334/76

[51] Int. Cl.[2] ..... D03D 49/12

[52] U.S. Cl. ..... 139/114; 139/97

[58] Field of Search ..... 139/114, 115, 97; 66/213

[56] References Cited

U.S. PATENT DOCUMENTS

| | | | |
|---|---|---|---|
| 2,442,796 | 6/1948 | Young | 66/213 |
| 2,589,498 | 3/1952 | Kulczycki et al. | 139/115 |
| 3,871,419 | 3/1975 | Pfarrwaller | 139/114 |

FOREIGN PATENT DOCUMENTS

| | | | |
|---|---|---|---|
| 4,333 of | 1890 | United Kingdom | 139/114 |

*Primary Examiner*—James Kee Chi

*Attorney, Agent, or Firm*—Bailey, Dority & Flint

[57] ABSTRACT

A device for equalizing the warp yarn tension in a loom having a movable back rest and a fixed beam spaced therefrom. The back rest is moved to and fro the beam during the weaving operations with the warp yarns extending thereover. A pressure cushion is carried between the back rest and the beam parallel to the back rest and the beam. The pressure cushion is compressed and relaxed as the back rest moves to and fro said beam during the weaving operation for equalizing the warp yarn tension.

8 Claims, 1 Drawing Figure

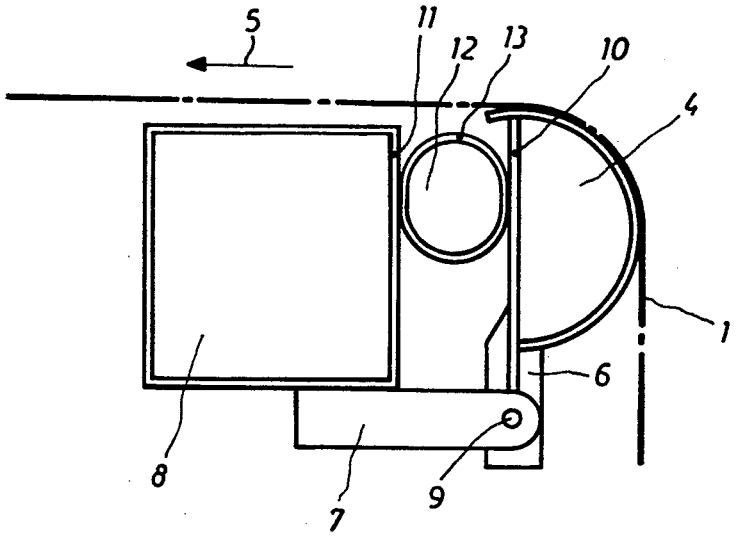
5
11
12
13
10
4
1
6
8
7
9

DEVICE FOR EQUALIZING THE WARP YARN TENSION IN A LOOM

BACKGROUND OF THE INVENTION

The invention refers to a device for equalizing the warp yarn tension in a loom having a movably supported back rest.

For equalizing the warp tension during the weaving process, especially during formation of the shed and during beat up of the reed, it is usual to arrange the back rest of the loom to be movable. In that case, three fundamental suspension systems are known. On the one hand, spring members are provided in the back rest suspension, the action of which is directed against the force exerted by the warp. On the other hand, the back rest is rigidly supported in a suspension which is moved positively in the direction of a yielding of the warp in time with the formation of the shed or with the beat up of the reed respectively. Finally, combinations of both systems are also know, in which the back rest is supported springily in a suspension moved positively and in time with the formation of the shed or the beat up of the reed respectively. All of the systems have the disadvantage in common, that the back rest suspension engages with the side frames of the loom at two points.

Since the warp force is distributed more or less uniformly along the length of the back rest from the sum of the forces from the individual warp threads, this two-point support demands a back rest resistant to bending with a corresponding weight, which is in the way of the above-mentioned movements for equalizing the warp tension.

Complete equalizing of the warp tension without the occurrence of peaks in the tension is thereby rendered substantially impossible.

SUMMARY OF THE INVENTION

The device in accordance with the invention for equalizing the warp thread tension is characterized in that the back rest is supported by at least one pressure cushion extending essentially in the direction longitudinal to the back rest.

In one embodiment of the invention as a result of the length of the pressure cushion being approximately equal to the width of warp, the back rest can be lightly built since no bending stresses arise in the back rest.

The cushion may, at least over one part of its periphery, consist of stretchable material such, for example, as soft rubber.

A solution which is inexpensive and is simple for replacement and repair results if the cushion consists of a hoselike body which bears against a stationary longitudinal beam of the loom frame, in which case, the hoselike body may be filled with a liquid or gaseous substance. In the case of such a pressure cushion, the contents may also be connected to a source of constant pressure.

Accordingly, it is an object of the present invention to provide a device for equalizing the warp tensions during weaving operation on a loom.

Another important object of the present invention is to provide a pressure cushion between a back rest and a longitudinal beam of a loom for equalizing the tension in the warp during weaving.

These and other objects and advantages of the invention will become apparent upon reference to the following specification, attendant claims and drawing.

BRIEF DESCRIPTION OF THE DRAWING

The FIGURE illustrates in schematic form an example of a warp tension equalizing device constructed in accordance with the present invention.

DESCRIPTION OF THE PREFERRED EMBODIMENT

Referring to the drawing, the warp 1 is shown approaching from the warp beam (not shown), which comes over the back rest 4 in the direction of the arrow 5 to the heddles (not shown) of a shed-forming device. The back rest 4 is carried by levers 6 which are supported pivotally on lugs 7 on a longitudinal beam 8 of the loom by means of pivots 9. Between the rear wall 10 of the half-round hollow back rest 10 illustrated and the rear wall 11 of the longitudinal beam 8 is a hoselike cushion 12 having a membrane-like jacket 13 which extends along the entire length of the back rest 10 and beams. The cushion is filled with a filling of liquid or gaseous substance. The filling is at any pressure which may be chosen and kept constant by connection of the cushion to a suitable source of pressure. Instead of that, the filling may also be enclosed hermetically in the pressure cushion. The movements of the back rest have, as a rule, modest amplitudes, on account of which it is also sufficient to produce the jacket from inextensible material and to enclose the filling hermetically in the jacket. In this case, upon the back rest approaching the stationary beam 8, a slight rise in pressure takes place in the filling, in which case, however, the equalizing of the warp tension is not quite total but, in most cases, it is sufficient. Improvement follows if the jacket consists of material which is stretchable or has the elasticity of rubber. The pressure cushion may also consist in its entirety of a material having the elasticity of rubber such, e.g., as plastics, in which case, a number of short pressure cushions may be arranged in an interrupted row on the rear wall 11 of the longitudinal beam 8. The cushion may also contain a solid porous filling material and, in addition, be filled with a liquid or gaseous substance.

While a preferred embodiment of the invention has been described using specific terms, such description is for illustrative purposes only, and it is to be understood that changes and variations may be made without departing from the spirit or scope of the following claims.

What is claimed is:

1. A device for equalizing the warp yarn tension in a loom having a movable back rest and a fixed member spaced therefrom in the direction of the movement of the back rest during the normal weaving operation, said back rest moving to and fro during the weaving operation with said warp yarns extending thereover, said device comprising:

means for pivotally mounting said back rest relative to said fixed member, a pressure cushion carried between said back rest and said fixed member parallel to said back rest and said fixed member, said pressure cushion being compressed and relaxed as said back rest moves to and fro said fixed member during the weaving operation for equalizing the warp yarn tension.

2. The device as set forth in claim 1 wherein said pressure cushion is approximately the same length as the width of the warp and is in the form of a flexible tube.

3. The device as set forth in claim 1 wherein said pressure cushion comprises:

a jacket of stretchable material extending around the periphery of at least a portion of said entire pressure cushion.

4. The device as set forth in claim 1 wherein said fixed member comprises:

a stationary longitudinal beam of the loom frame, and wherein said pressure cushion includes a hose-like jacket which bears against said stationary longitudinal beam.

5. The device as set forth in claim 1 further comprising:

a liquid carried within said pressure cushion.

6. The device as set forth in claim 1 further comprising a gaseous substance carried within said pressure cushion.

7. A device as set forth in claim 5 further comprising:

a source of constant pressure connected to said pressure cushion for maintaining said liquid under pressure.

8. A device as set forth in claim 6 further comprising:

a source of constant pressure connected to said pressure cushion for maintaining said gaseous substance under pressure.

* * * * *